US007594358B2

(12) United States Patent
Harari et al.

(10) Patent No.: US 7,594,358 B2
(45) Date of Patent: Sep. 29, 2009

(54) PROFILE OF SLIDING DOOR ROLLER ASSEMBLING

(75) Inventors: Mordechai Harari, Rishon Lezion (IL); Amos Halfon, Sitira (IL)

(73) Assignee: Hardoor Mechanism Productions Ltd., Rishon Lezion (IL)

( * ) Notice: Subject to any disclaimer, the term of this patent is extended or adjusted under 35 U.S.C. 154(b) by 580 days.

(21) Appl. No.: 11/156,011

(22) Filed: Jun. 20, 2005

(65) Prior Publication Data

US 2005/0229494 A1 Oct. 20, 2005

Related U.S. Application Data

(63) Continuation of application No. PCT/IL2003/000510, filed on Jun. 18, 2003.

(60) Provisional application No. 60/434,808, filed on Dec. 20, 2002.

(30) Foreign Application Priority Data

Jun. 15, 2003 (IL) ..... 156925

(51) Int. Cl.
*E05D 13/00* (2006.01)

(52) U.S. Cl. ..... 49/425; 49/410; 49/411

(58) Field of Classification Search ..... 49/404, 49/409, 410, 411, 425
See application file for complete search history.

(56) References Cited

U.S. PATENT DOCUMENTS

| | | | | | |
|---|---|---|---|---|---|
| RE13,547 | E | * | 3/1913 | Overly | 49/425 |
| 1,176,152 | A | * | 3/1916 | Lawrence | 16/105 |
| 1,235,152 | A | * | 7/1917 | Nelson | 49/388 |
| 1,783,732 | A | * | 12/1930 | Levi | 49/439 |
| 2,659,939 | A | * | 11/1953 | Greig | 49/425 |
| 2,664,598 | A | * | 1/1954 | Greig | 49/420 |
| 2,786,240 | A | * | 3/1957 | Tobiasz | 49/425 |
| 2,798,262 | A | * | 7/1957 | Beamer | 52/800.13 |
| 3,040,391 | A | | 6/1962 | Saunders | |
| 3,064,723 | A | * | 11/1962 | Paillard et al. | 160/194 |
| 3,085,298 | A | * | 4/1963 | Metzger | 49/417 |
| 3,178,834 | A | * | 4/1965 | Dyer et al. | 434/413 |
| 3,281,993 | A | | 11/1966 | Riegelman | |
| 3,397,487 | A | * | 8/1968 | Hunt et al. | 49/130 |
| 3,509,665 | A | * | 5/1970 | Bartlett et al. | 49/410 |
| 3,510,985 | A | * | 5/1970 | Smits | 49/425 |
| 3,526,995 | A | * | 9/1970 | Saunders | 49/420 |
| 3,530,618 | A | | 9/1970 | Grossman | |
| 3,748,784 | A | | 7/1973 | Smits | |
| 3,750,337 | A | * | 8/1973 | Brydolf et al. | 49/411 |
| 3,852,916 | A | | 12/1974 | Laby | |
| 3,879,912 | A | * | 4/1975 | Cox | 52/734.1 |

(Continued)

*Primary Examiner*—Katherine W Mitchell
*Assistant Examiner*—Catherine A Kelly
(74) *Attorney, Agent, or Firm*—Martin Fleit; Paul D. Bianco; Fleit Gibbons Gutman Bongini & Bianco PL

(57) ABSTRACT

The present invention provides a new sliding assembly for a sliding closure. The present invention is constructed of two metal profiles mounted on each side wall of sliding closure and guiding bars for sliding on said rail. The profiles design includes a rail which length, is adjusted to the sliding closure height. The lower sliding bar is attached to a roller, which slides along the lower track of the closure. The second sliding bar is attached to the guiding bar for sliding along the upper track of the closure. An elastic stretching means connects between the lower sliding bar and the profile.

12 Claims, 8 Drawing Sheets

U.S. PATENT DOCUMENTS

| | | | | | |
|---|---|---|---|---|---|
| 3,959,849 | A | | 6/1976 | Marquardt | |
| 4,006,513 | A | * | 2/1977 | Offterdinger | 16/99 |
| 4,014,378 | A | | 3/1977 | Kochanowski | |
| 4,031,665 | A | * | 6/1977 | Abramson | 49/501 |
| 4,123,874 | A | * | 11/1978 | Scott | 49/411 |
| 4,193,500 | A | * | 3/1980 | Scott | 206/577 |
| 4,253,278 | A | | 3/1981 | Dallaire | |
| 4,301,623 | A | * | 11/1981 | Demukai | 49/404 |
| 4,319,431 | A | * | 3/1982 | Siers | 49/426 |
| 4,404,771 | A | * | 9/1983 | Murase et al. | 49/425 |
| 4,478,006 | A | | 10/1984 | Johnson | |
| 4,513,554 | A | * | 4/1985 | Johnson et al. | 52/657 |
| 4,574,524 | A | * | 3/1986 | Bonetti et al. | 49/130 |
| 4,640,053 | A | * | 2/1987 | Lew | 49/501 |
| 4,644,690 | A | * | 2/1987 | Caimi | 49/130 |
| 4,708,410 | A | * | 11/1987 | Mazaki | 312/138.1 |
| 4,850,145 | A | * | 7/1989 | McAfee | 49/501 |
| 4,880,046 | A | * | 11/1989 | Gesy | 160/194 |
| 5,048,232 | A | * | 9/1991 | Miyagawa et al. | 49/440 |
| 5,119,872 | A | * | 6/1992 | Engebretson | 160/381 |
| 5,287,653 | A | * | 2/1994 | Young | 49/130 |
| 5,287,655 | A | * | 2/1994 | Harvey | 49/425 |
| 5,343,594 | A | * | 9/1994 | Harvey | 16/105 |
| 5,349,783 | A | * | 9/1994 | Jasperson et al. | 49/425 |
| 5,671,502 | A | * | 9/1997 | Ezman | 16/105 |
| 5,724,770 | A | * | 3/1998 | McAfee | 49/409 |
| 5,845,363 | A | | 12/1998 | Brempell et al. | |
| 5,964,061 | A | * | 10/1999 | Hughes et al. | 49/425 |
| 6,065,249 | A | * | 5/2000 | Gephart et al. | 49/425 |
| 6,272,793 | B1 | * | 8/2001 | Davlantes | 49/168 |
| 6,402,611 | B1 | * | 6/2002 | Rohrbaugh | 454/169 |
| 6,434,789 | B1 | * | 8/2002 | Kruse | 16/93 R |
| 6,644,380 | B2 | * | 11/2003 | Perich et al. | 160/381 |

* cited by examiner

PROFILE OF SLIDING DOOR ROLLER ASSEMBLING

BACKGROUND

This application is a continuation of international application Ser. No. PCT/IL2003/000510, filed on Jun. 18, 2003, which in turn claimed priority to U.S. Provisional application Ser. No. 60/434,808, filed on Dec. 20, 2002.

The present invention relates to sliding doors that utilize roller assemblies to move back and forth within tracks. Such assemblies are well known in the prior art and have undergone various modifications in order to allow the doors to roll progressively more freely and efficiently.

Some of the problems encountered in the past with sliding door mechanisms include imperfections or other obstacles in the tracks, which cause the rolling doors to get stuck, become difficult to move or to be derailed from the track. A well-known solution to this problem is to construct spring based roller mechanisms, which allow the wheels to skip over obstacles or slight variations and guide the door freely through the track.

Another factor that affects the level of functionality of sliding door roller assemblies is the level of adjustability and ease of assembly. U.S. Pat. No. 5,845,363 describes a mechanism that is easy and inexpensive to construct, and includes an adjustment gear that is readily accessible to the user. U.S. Pat. No. 4,253,278 describes a similar device. The height of the mechanism can be adjusted according to the track after it has been installed.

Another roller assembly is described in U.S. Pat. No. 3,959,849, which discloses an assembly that can be installed without the help of special tools or a skilled worker. This assembly features tabs that are fixed on the sides of the roller housing in order to stabilize door movement.

The disadvantage of the assemblies as described above is that the installation of the rollers is complex and requires adjustment of the roller assembly to each sliding door type. The present invention offers a simple and affordable solution to this problem by incorporating an extra adjustable feature in order to enable the simple assembly of the roller device to any type of sliding door. This contributes to the ease of building constructions using sliding door mechanisms or replacing old parts when needed.

Further more, prior art sliding structures which are constructed as exterior part of the sliding door are fragile and may be unstable.

It is thus the prime object of the invention to avoid the limitations of the prior art and to provide a simple and stable sliding mechanism.

SUMMARY

The present invention provides a new sliding assembly for a sliding door closure comprised of: two metal profiles mounted on each side wall of sliding closure, said profiles design includes a rail wherein the rail length is adjusted to the sliding closure height, a guiding roller for rolling along the lower closure track, a guiding bar for sliding along the upper track wherein the guiding bar is attached to the track by pressure means, a first sliding bar attached to the roller for sliding along lower part of rail, a second sliding bar attached to the guiding bar for sliding along the upper part of rail; elastic stretching means for connecting between at least one sliding bar and the profile, and adjustable fastening means installed on the profile in a position which maintains said elastic means under compression so as to limit the optimum outward position of at least one sliding bar.

BRIEF DESCRIPTION OF THE DRAWINGS

These and further features and advantages of the invention will become more clearly understood in light of the ensuing description of a preferred embodiment thereof, given by way of example only, with reference to the accompanying drawings, wherein.

DETAILED DESCRIPTION OF THE PREFFERED EMBODIMENTS

The present invention provides a novel roller assembly for the track of a sliding door. The assembly has a unique structure that enables simple adjustment of its components to correspond to variable sizes of sliding doors and respective built-in tracks of closets, cupboards, or any other structure incorporating a sliding door.

Figure 1:
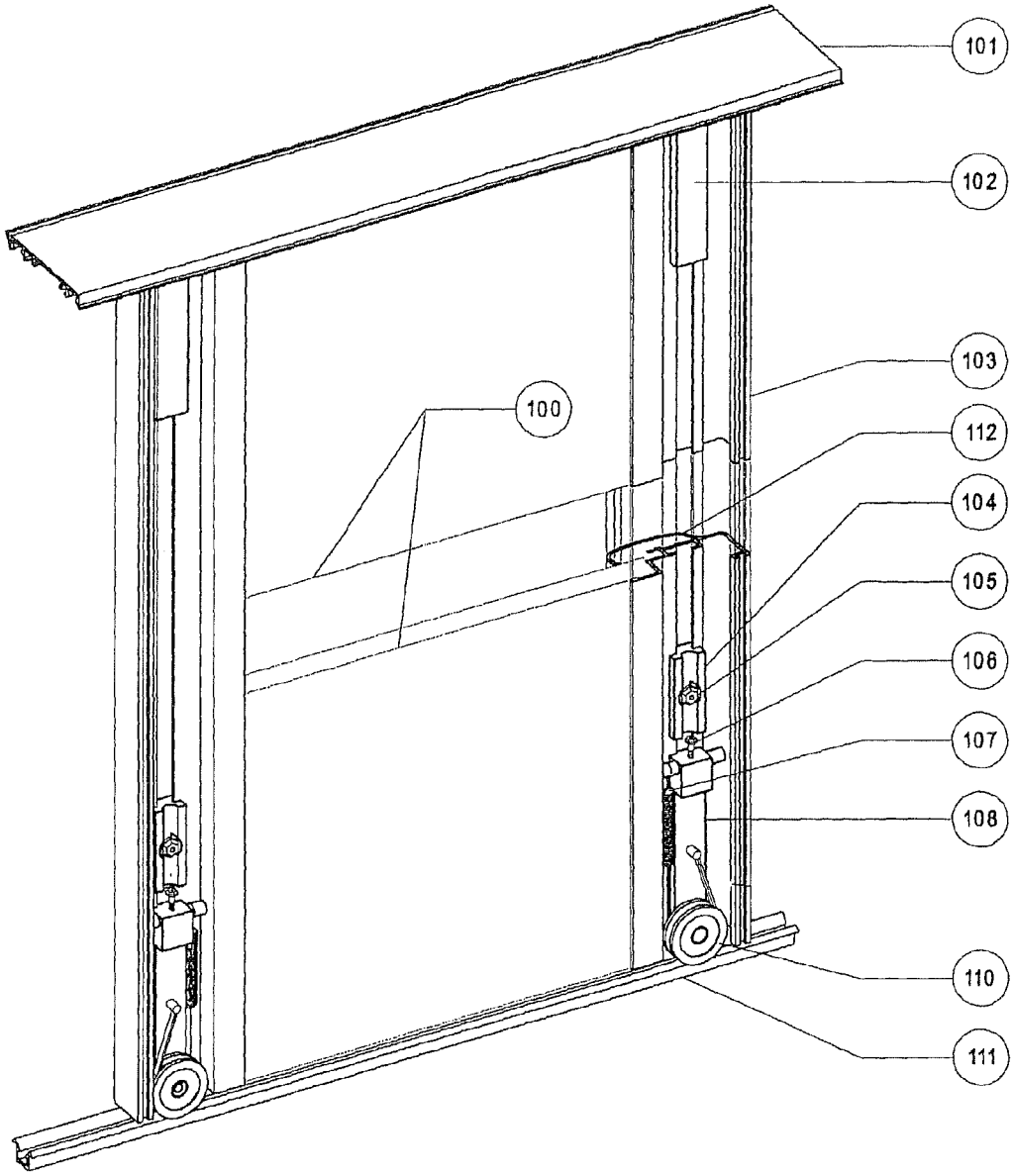
FIG. 1 is a perspective view of the present invention.
Figure 2:
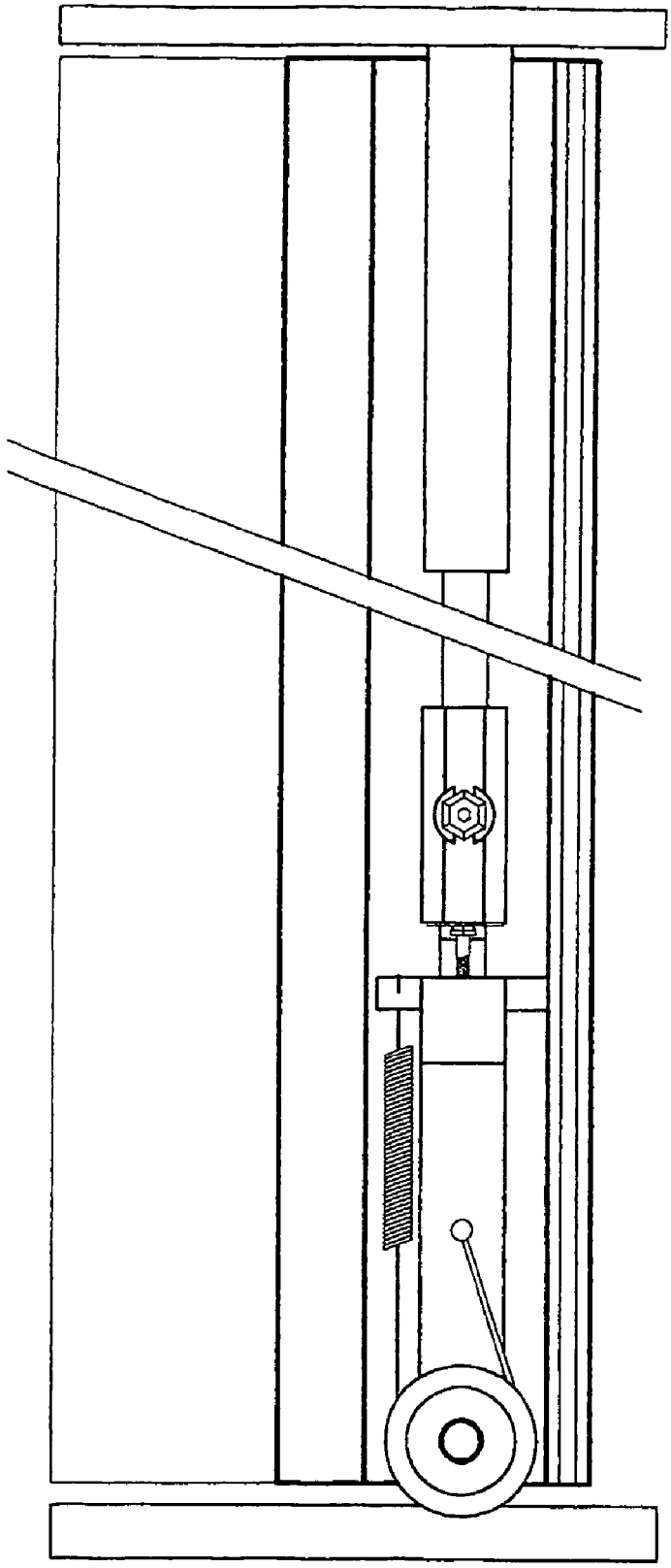
FIG. 2 is an enlarged frontal view of the present invention.
Figure 3:
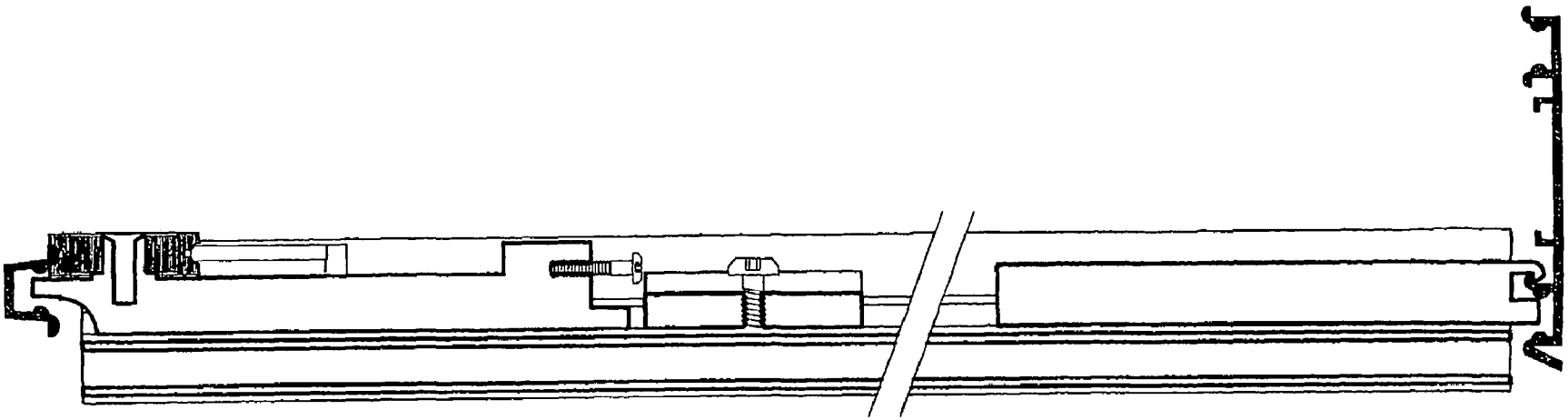
FIG. 3 is a detailed cross section of the present invention.

The roller assembly's main components can be seen in FIG. 1 and are described below.

The assembly includes two identical metal profiles (103), a unique component of the present invention, designed to be mounted on each side of the sliding door (100).

Prior art sliding mechanism are exterior parts which are mounted at the bottom of the sliding door, according to the present invention the sliding mechanism is mounted in the profiles, thus providing stable sliding structure.

These profiles allow for easy installation of the apparatus and further stabilize and strengthen the door to which they are mounted. Part of each metal profile forms a rail (112) along the side. Two sliding bars (102 and 108) are designed to slide along the rail (112). The lower sliding bar (108) is positioned on the lower part of the sliding door side and is attached to the roller (110), which guides the door through the lower track (111). The upper sliding bar (102) is positioned on the top part of the door's side and is designed to guide the metal profile and attached door along the specific upper track (101) described in the present invention.

Figure 6C:
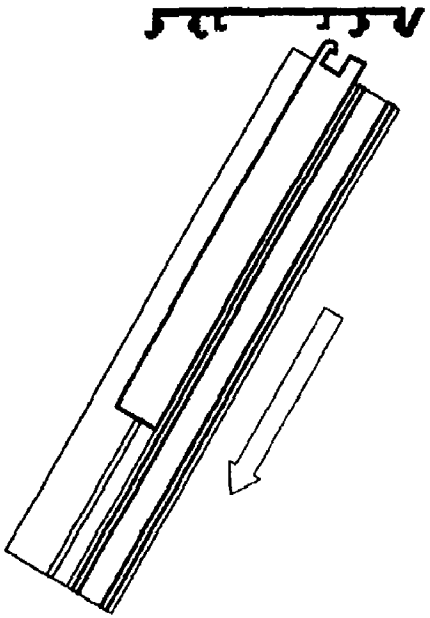
FIGS. 6*b* and 6*c* are diagrams illustrating the process of removing the upper sliding bar from the upper track.
Figure 6B:
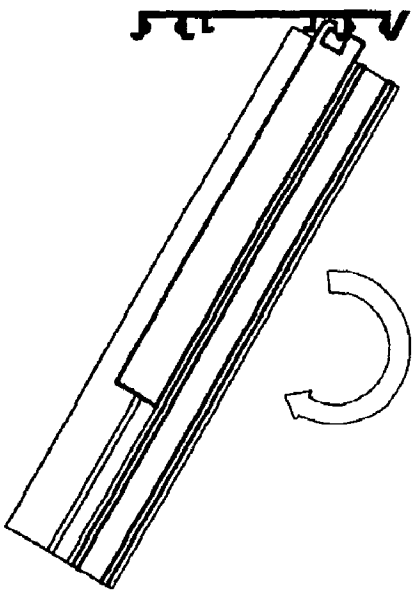
Figure 6A:
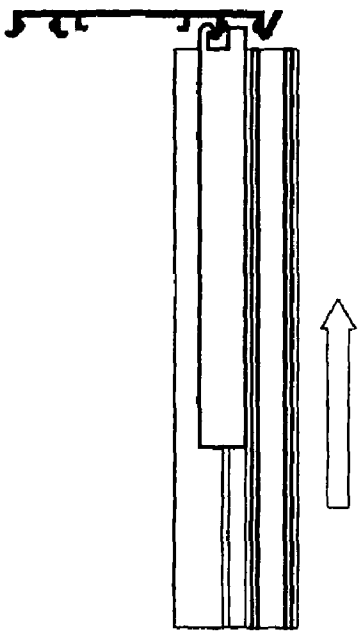
FIG. 6*a* is a diagram showing the process of connecting the upper sliding bar to the upper track.
Figure 9D:
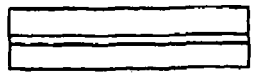
FIG. 9*d* is an enlarged side view of the barrier.
Figure 9A:
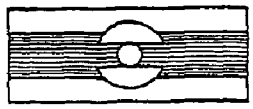
FIG. 9*a* is an enlarged front view of the barrier.
Figure 9B:
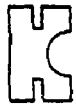
FIG. 9*b* is an enlarged top view of the barrier.
Figure 9C:
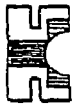
FIG. 9*c* is an enlarged top cross-section of the barrier.

Upon assembly, the upper sliding bar is easily clicked into place along the track using pressure. However, to prevent unwanted derailing, the sliding bar is designed to be removed only when turned 45 degrees away from the track, which is impossible while it is connected to the door. The processes of installing and removing the sliding bar are shown in FIGS. 6*a* and 6*b* respectively. This bar also contains a small pin that holds it in place along the metal profile before assembly.

Figure 8C:
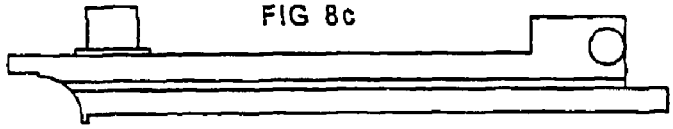
FIG. 8*c* is an enlarged side view of the lower sliding bar.
Figure 8A:
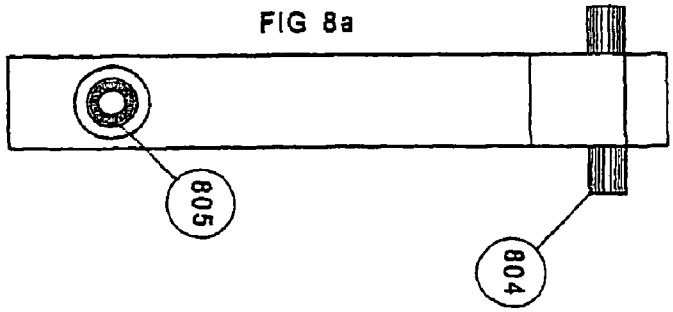
FIG. 8*a* is an enlarged front view of the lower sliding bar.
Figure 8B:
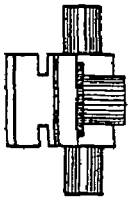
FIG. 8*b* is an enlarged top view of the lower sliding bar.
Figure 7B:
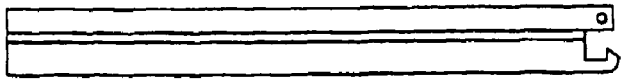
FIG. 7*b* is an enlarged side view of the upper sliding bar.
Figure 7A:
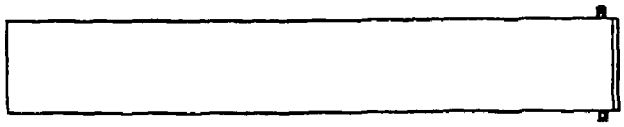
FIG. 7*a* is an enlarged front view of the upper sliding bar.
Figure 7C:
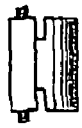
FIG. 7*c* is an enlarged top view of the upper sliding bar.

The lower sliding bar involves several components that contribute to the adjustability of the present invention and to the ease of movement of the door. These components can be seen assembled and disassembled in FIGS. 8*a* and 8*b* respectively. The roller (110), positioned at the bottom of the sliding bar (108), guides the bar through the lower track (111). This roller is attached to the respective pin (805) on the bar using pressure during assembly process of the invention. There is a groove running throughout the center of the roller, which rolls along the one side of the lower track to prevent derailing. Along the center of this groove runs a smaller, deeper groove for minimizing friction.

Figure 4C:
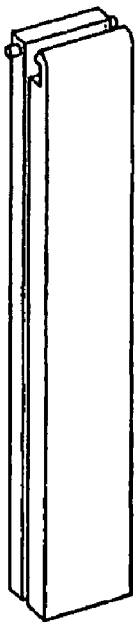
FIG. 4*c* is an enlarged perspective view of the upper sliding bar.
Figure 4B:
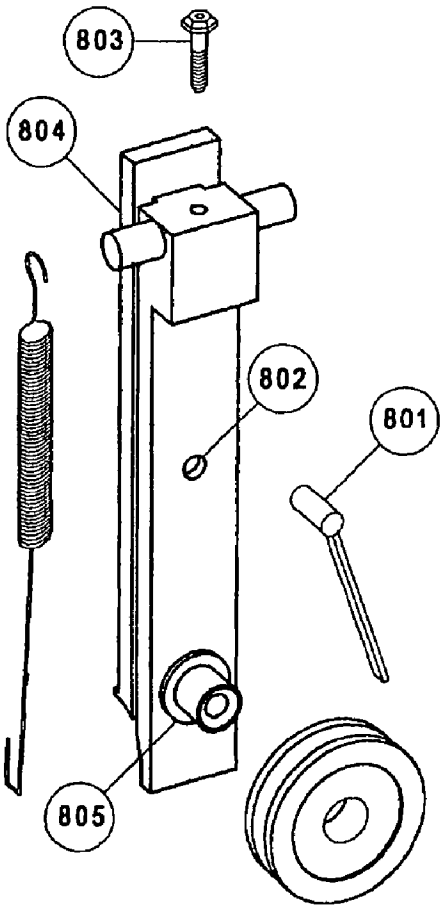
FIG. 4*b* is an enlarged perspective view of the lower sliding bar components.
Figure 4A:
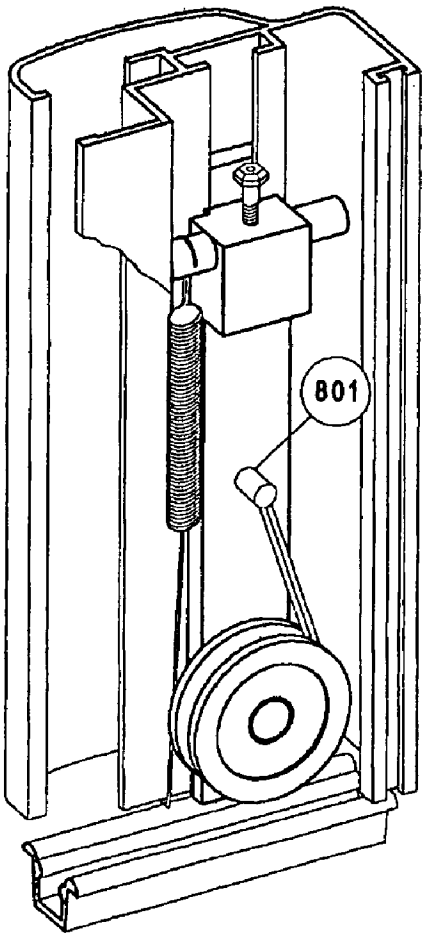
FIG. 4*a* is an enlarged front view of the lower sliding bar as implemented within the metal profile.
Figure 4D:
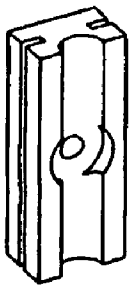
FIG. 4*d* is an enlarged perspective view of the barrier not including the fastening bolt.
Figure 5:
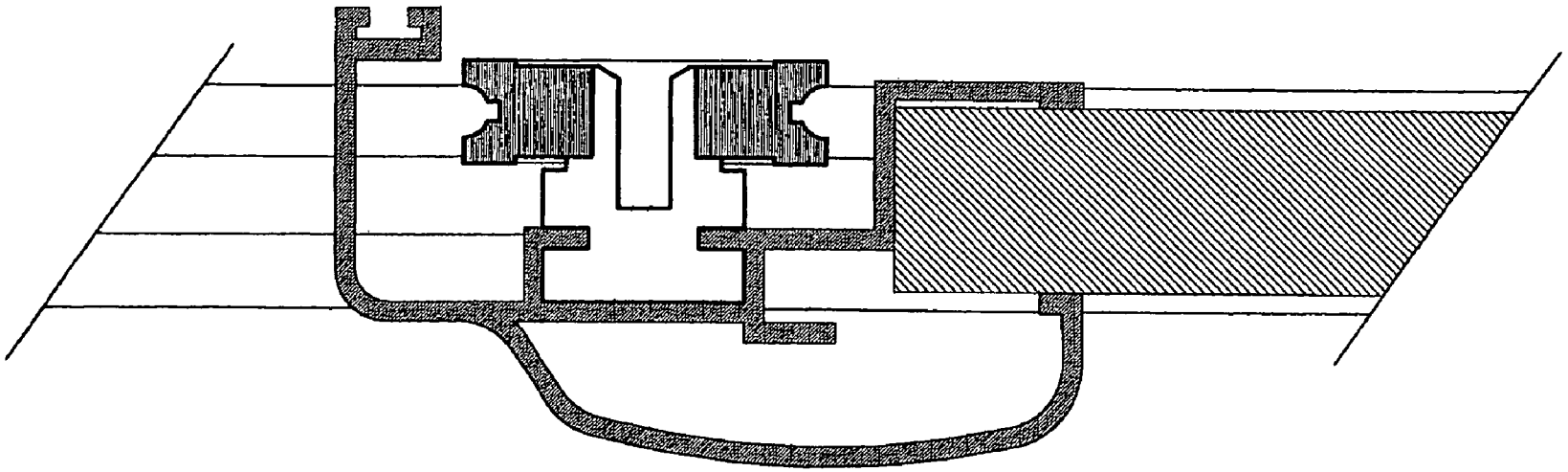
FIG. 5 is an enlarged top view of the metal profile.

Optionally, on the sliding bar above the roller is mounted a pin holding a strip of plastic (801) (se FIGS. 4*a* and 4*b*). This pin is attached to the sliding bar by inserting it into the corresponding positioned hole (802) in the bar. The strip is designed to fit within the outer groove of the roller and wipe away dust and other small obstacles during the movement of the door.

An adjustment mechanism (106) is positioned at the top of the lower sliding bar (108). This mechanism is designed for balancing the lower sliding bar height to fit the specific door track structure. It contains a bolt (803) at the top and a small rod (804) running through its center.

The lower sliding bar also contains a coil spring (107), which is attached from one side by a hook to the rod (804) and connects on the other side to the bottom of the metal profile (103), also using a hook on its other end. The spring provides flexibility for the sliding bar and allows the door to slide freely despite any obstructions within the lower track (111).

Above the lower sliding bar (108), a barrier (104) is positioned within the track of the metal profile (103) and is fastened to it with a bolt (105) to constrain the movement of the sliding bar (108).

The metal profile of the assembly can be distributed as long rod. The carpenter who installs the roller assembly can cut the rod at any size, adjusting the metal profile rail length to the sliding door height. The fastening member can be positioned at any point along the sliding door side and adjusted to the size of the specific track used in the structure. The invention can then be easily adjusted to the height of the sliding door by turning the bolt that controls the adjustment mechanism.

Figure 10:
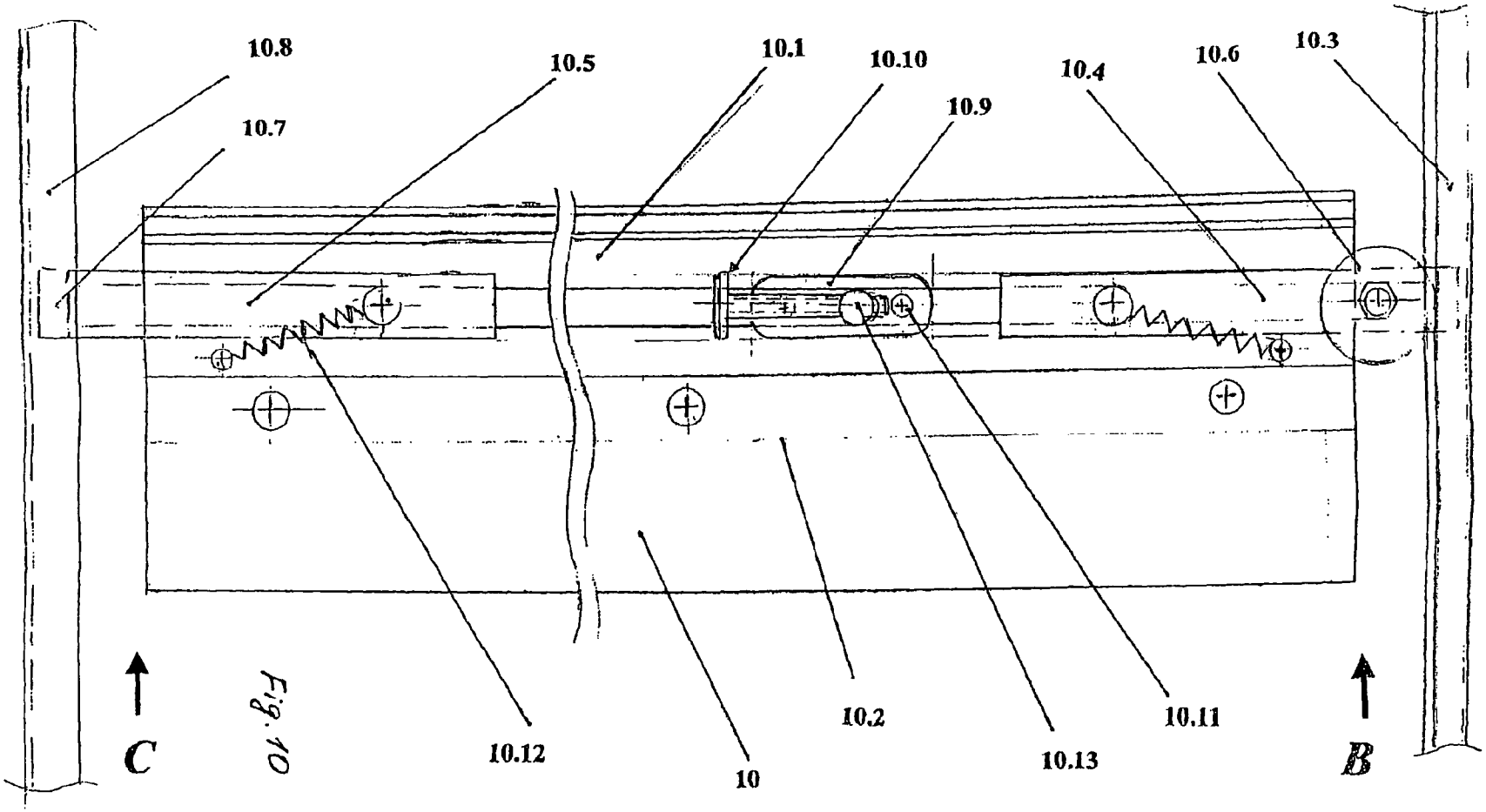
FIG. 10 is an alternative structure of the present invention.

The present invention can be constructed according to a different design as illustrated in FIG. 10.

According to an alternative design the assembly includes two metal profiles (10.01) mounted on each side wall (10.00) of the sliding door. Part of this metal profile forms a rail along the side wall (10.02). Two sliding bars are designed to slide along the trail (10.02). The first bar (10.4) positioned on the lower part of the sliding door side wall and is attached to the roller (10.06), which guides the door through the lower track (10.03). The second sliding bar (10.05) is positioned on the top part of the door wall and is attached to the guiding bar (10.07) above the door, which slides along the upper track (10.08).

Above the lower sliding bar (10.04) is an adjustment mechanism (10.09), controlled by the adjustment bolt (10.10), placed in a groove within the metal profile (10.01). This mechanism is designed to enable the balance the two sliding bars (10.04 and 10.05).

Two coil springs (10.11 and 10.12) connect each of the sliding bars to the metal profile. This provides flexibility, which allows the door to slide freely despite any obstructions within the track (10.03). A fastening member (10.13) is positioned as barrier constraining the movement of the sliding bars (10.04,10.05).

The metal profile (10.02) of the assembly can be distributed as long rod. The carpenter who installs the roller assembly can cut the rod at any size, adjusting the metal profile rail length to the sliding door height. The fastening member (10.13) can be positioned at any point along the sliding door side wall (10.00) and adjusted to the size of the specific track (10.03) used in the structure. The invention can then be easily adjusted to the height of the sliding door by turning the bolt (10.10) that controls the adjustment mechanism (10.09).

While the above description contains many specifities, these should not be construed as limitations on the scope of the invention, but rather as exemplifications of the preferred embodiments. Those skilled in the art will envision other possible variations that are within its scope. Accordingly, the scope of the invention should be determined not by the embodiment illustrated, but by the appended claims and their legal equivalents.

What is claimed is:

1. A sliding assembly for enabling:

installing said sliding assembly onto a door of a closet comprising an upper and a lower track for sliding doors; and for enabling installing said door and assembly into the tracks of said closet allowing the assembly attached to said door to slide therein, wherein said sliding assembly comprises:

two metal profiles mounted on each side wall of sliding closure, each said profile includes a rail;

a guiding roller installed in each profile for rolling along a lower track of said closet;

a guiding bar installed in each profile for sliding along an upper track of said closet wherein the guiding bar is attached to the track;

a first sliding bar installed in each profile, each said first sliding bar is attached to the roller for sliding along the lower part of the rail;

a second sliding bar installed in each profile, each said second sliding bar is attached to the guiding bar for sliding along the upper part of the rail;

a barrier with an adjustment bolt, said barrier is slidable within the rail, wherein said bolt fastens said barrier to the rail of the profile, to limit the movement of the first sliding bar within the rail;

an adjustment mechanism adjustably installed in each profile rail, said adjustment mechanism fastened to at least one sliding bar; and Elastic means for connecting each sliding bar to the profile, wherein said elastic means maintains tension between said profile and said first sliding bar, by connecting to the profile's edge at one end and to the sliding bar at the other end, wherein: the roller, sliding bar, guiding bars, elastic means, adjustment mechanism and barrier that are installed at each side of the door are situated within the rail of the profile.

2. The sliding assembly of claim 1 wherein the elastic means comprises a hook at one end connecting to the adjustment mechanism connected to the sliding bar, wherein the other end of said elastic means is connected to the edge of the profile rail.

3. The sliding assembly of claim 1 wherein the elastic means is connected to the first sliding bar and to the profile using fastening means.

4. The sliding assembly of claim 1 wherein the elastic means is connected to the second sliding bar using fastening means at one edge and to the profile by a hook at the opposite edge.

5. The sliding assembly of claim 1 wherein the elastic means is connected to the second sliding bar and the profile using fastening means.

6. The sliding assembly of claim 1 wherein the guiding bar of the upper edge is designed to fit the upper track and the guiding bar is attached to the track by applying pressure at vertical position and the guiding bar is disconnected when turned by 45 degrees with respect to the track.

7. The sliding assembly of claim 1 wherein the guiding roller design includes a pin at the lower part, said pin designated for mounting the rolling disc upon.

8. The sliding assembly of claim 1 wherein the guiding roller further includes rubber strip positioned above the rolling disc, said strip designated for cleaning in rolling disc groove.

9. The sliding assembly of claim 8 wherein the guiding roller rolling disc further includes an inner groove.

10. The sliding assembly of claim 1 wherein the guiding bar includes small pins at the upper part of the bar side, said pins designated for keeping the bar at the upper part of the rail during the assembly process.

11. The sliding assembly of claim 1 wherein the guiding roller further includes adjustment means at the top of the first sliding bar.

12. The sliding assembly of claim 1, wherein each said adjustment mechanism is an adjustment bolt positioned at the top of the first sliding bar, wherein said bolt fine adjusts of the position where the bolt of the adjustment mechanism meets the barrier.

* * * * *